United States Patent [19]

Reifenhäuser

[11] Patent Number: 5,028,375

[45] Date of Patent: Jul. 2, 1991

[54] PROCESS FOR MAKING A SPUN-FILAMENT FLEECE

[75] Inventor: Hans Reifenhäuser, Troisdorf, Fed. Rep. of Germany

[73] Assignee: Reifenhauser GmbH & Co. Maschinenfabrik, Troisdorf, Fed. Rep. of Germany

[21] Appl. No.: 323,231

[22] Filed: Mar. 13, 1989

Related U.S. Application Data

[63] Continuation of Ser. No. 119,399, Nov. 10, 1987, abandoned.

[30] Foreign Application Priority Data

Jan. 21, 1987 [DE] Fed. Rep. of Germany ..... 3701531

[51] Int. Cl.[5] ..... D02B 1/22

[52] U.S. Cl. ..... 264/518; 264/103; 264/210.8; 264/555

[58] Field of Search ..... 425/72.2, 80.1, 83.1; 19/299; 156/167; 264/103, 555, 518, 210.8

[56] References Cited

U.S. PATENT DOCUMENTS

| | | | |
|---|---|---|---|
| 2,881,471 | 4/1959 | Snow et al. . | |
| 3,684,416 | 8/1972 | Lenk | 425/72 |
| 3,707,593 | 12/1972 | Fukada et al. | 19/299 |
| 3,787,195 | 3/1974 | Kirchheim | 425/81 |
| 3,802,817 | 4/1974 | Matsuki et al. | 425/83.1 |
| 3,812,553 | 5/1974 | Marshall et al. | 19/156.3 |
| 3,963,392 | 6/1976 | Goyal | 425/83 |
| 3,969,462 | 7/1976 | Stofan | 264/237 |
| 3,988,086 | 10/1976 | Marshall et al. | 425/72 |
| 4,017,580 | 4/1977 | Barbey | 425/83.1 |
| 4,025,595 | 5/1977 | Mirhej | 264/103 |
| 4,217,078 | 8/1980 | Buell | 425/81.1 |
| 4,269,888 | 5/1981 | Ejima et al. | 156/167 |
| 4,285,646 | 8/1981 | Waite | 425/725 |
| 4,318,676 | 3/1982 | Gerking et al. | 264/103 |
| 4,340,563 | 7/1982 | Appel et al. | 264/518 |
| 4,388,056 | 6/1983 | Lee et al. | 264/518 |
| 4,442,062 | 4/1984 | Fujii et al. | 425/83.1 |
| 4,553,996 | 11/1985 | Muschelknautz et al. | 264/12 |
| 4,612,150 | 9/1986 | De Howitt | 264/103 |
| 4,692,106 | 9/1987 | Grabowski et al. | 425/66 |

FOREIGN PATENT DOCUMENTS

| | | | |
|---|---|---|---|
| 2658518 | 6/1978 | Fed. Rep. of Germany | 264/40.3 |
| 2906618 | 8/1980 | Fed. Rep. of Germany | 425/72.2 |
| 47-50003 | 12/1972 | Japan | 425/72.2 |
| 51-007204 | 3/1976 | Japan . | |

*Primary Examiner*—David A. Simmons
*Assistant Examiner*—Allan R. Kuhns
*Attorney, Agent, or Firm*—Herbert Dubno

[57] ABSTRACT

The process for making a spun-filament fleece from at least two stretched thermoplastic monofilaments made of a thermoplastic material includes feeding thermoplastic material to at least two spinnerets each including a separate group or plurality of spinning nozzles arranged in rows over a rectangular cross section, then exposing each band or group of thermoplastic filaments issuing from each group of spinning nozzles separately to a transverse flow of cooling air in a blower shaft, next stretching the bands or groups of thermoplastic filaments jointly in a common central stretching shaft by outflowing stretching air, then depositing jointly the thermoplastic filaments which have been stretched in a spun band moving below the stretching shaft continuously to form the spun-filament fleece and drawing a suction air flow through the spun band and/or the spun-filament fleece being formed.

4 Claims, 3 Drawing Sheets

PROCESS FOR MAKING A SPUN-FILAMENT FLEECE

This is a continuation of co-pending application Ser. No. 119,399, filed on Nov. 10, 1987, now abandoned.

CROSS REFERENCE TO RELATED APPLICATIONS

This application is related to the concurrently filed copending application Ser. Nos. 07/119,141, filed Nov. 10, 1098 and 06/637,401, filed Aug. 3, 1984.

FIELD OF THE INVENTION

My present invention relates to a process for making a spun-filament fleece and to the manufacture of a spun-filament fleece from thermoplastic monofilament.

BACKGROUND OF THE INVENTION

Spun-filament fleece can be made from a stretched thermoplastic monofilament of a thermoplastic synthetic resin by feeding the thermoplastic material to a spinneret including a plurality of spinning nozzles arranged in rows over a rectangular plan pattern, then exposing a band or group of the thermoplastic filaments issuing from the spinning nozzles to a transverse flow of cooling air in a blower shaft, next stretching the thermoplastic filaments in a stretching shaft by outflowing stretching air, then depositing the thermoplastic filaments which have been stretched on an air-permeable belt moving below the stretching shaft continuously to form the spun-filament fleece and drawing a suction air flow through the belt and the spun-filament fleece being formed.

In the known process for making a spun-filament fleece as described in German Patent Document 35 03 818 the spinning nozzles used are provided in a single spinneret or aggregate. A single band or group of plastic monofilaments issues from the spinneret. Such systems have been proven in practice but it leads to certain limitations. On the one hand the throughput per spinning nozzle and thus for the entire apparatus cannot be arbitrarily increased. If it is so increased a reduction in the quality of the finished fleece results. On the other hand the fleece cannot be made from different thermoplastic materials or differently colored materials.

OBJECTS OF THE INVENTION

It is an object of my invention to provide an improved process for making a spun-filament fleece which will overcome these drawbacks.

It is another object of my invention to provide an improved process for making a spun-filament fleece which provides a substantially higher throughput than existing processes without impairing the quality of the finished fleece.

It is also an object of my invention to provide an improved process for making a spun-filament fleece which is made from different thermoplastic materials or different colored materials.

SUMMARY OF THE INVENTION

These objects and others which will become more readily apparent hereinafter are attained in accordance with my invention in a process for making a spun-filament fleece from a stretched thermoplastic monofilament made of a thermoplastic material comprising feeding the thermoplastic material to at least one spinneret including a plurality of spinning nozzles arranged in rows over a rectangular cross section, then exposing a band or group of thermoplastic filaments issuing from the spinning nozzles to a transverse flow of cooling air in a blower shaft, next stretching the thermoplastic filaments in a stretching shaft by outflowing stretching air, then depositing the thermoplastic filaments which have been stretched moving below the stretching shaft continuously to form the spun-filament fleece and drawing a suction air flow through the receiving conveyor and/or the spun-filament fleece or nonwoven mat being formed.

According to my invention the above objects are attained when the thermoplastic material is fed to at least two spinnerets each with a separate plurality of the spinning nozzles positioned above the blower shaft, each of the bands or groups of the thermoplastic filaments issuing from each of the spinnerets is separately exposed to the cooling air in the blower shaft and each of the bands or groups of the thermo plastic material are jointly fed into a central stretching shaft and are jointly deposited in the receiving conveyor.

To have particularly definite process conditions each of the bands of thermoplastic filaments is fed into a blower shaft which has a central separating wall connected to the spinnerets. In one embodiment of my invention each of the bands of thermoplastic filaments is fed into a blower shaft which have a central separating wall connected to the spinnerets. That means a forced blast or draft of air from air orifices or nozzles on the side walls of the blower shaft. In another example of my invention the bands or groups of the thermoplastic filaments are exposed to cooling air from the separating wall and from the exterior.

In one embodiment of the process according to my invention the separate spinnerets are identical and have an equal plurality of spinning nozzles. One can also use spinnerets which are not the same and do not have the same number of spinning nozzles. Besides it is possible to feed the plurality of spinning nozzles of each spinneret with different thermoplastic material, e.g. polypropylene can be fed to one spinneret while polyethylene is fed to another spinneret.

For example the softening point of these polymeric fibers is reduced by the mixing of the polyethylene with the polypropylene. The polyethylene fibers adhere to the fibers of pure polypropylene in a subsequent calendaring of the fleece or nonwoven mat. Because of that in spite of a reduced pressing temperature a comparatively strong fleece with a soft feel is produced.

One can also feed each spinneret having its own plurality of spinning nozzles with differently colored thermoplastic material.

Another example of my invention which can lead to a spun-filament fleece having a particularly good feel comprises feeding each spinneret having its own plurality of spinning nozzles with differently tempered thermoplastic material.

In each of the above examples of my invention it is possible to use different flow rates of thermoplastic material for different spinnerets. Thus a spun-filament fleece can be produced with groups of individual fibers having a different filament thickness (e.g. one group of fibers having 1.5 to 3 dtex and simultaneously another group with 6 to 8 dtex).

The advantages of my process over the known process include a substantially higher throughput without impairing the fleece quality. Moreover it is possible to make a spun-filament fleece from different thermoplastic materials or from different colored thermoplastic materials. It is also possible to change the physical parameters by operating with different flow rates or different spinning nozzles or orifices. It is understood that the stretched filaments are endless fibers. Of particular advantage is the fact that the process according to my invention can be realized very easily on a commercial scale.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
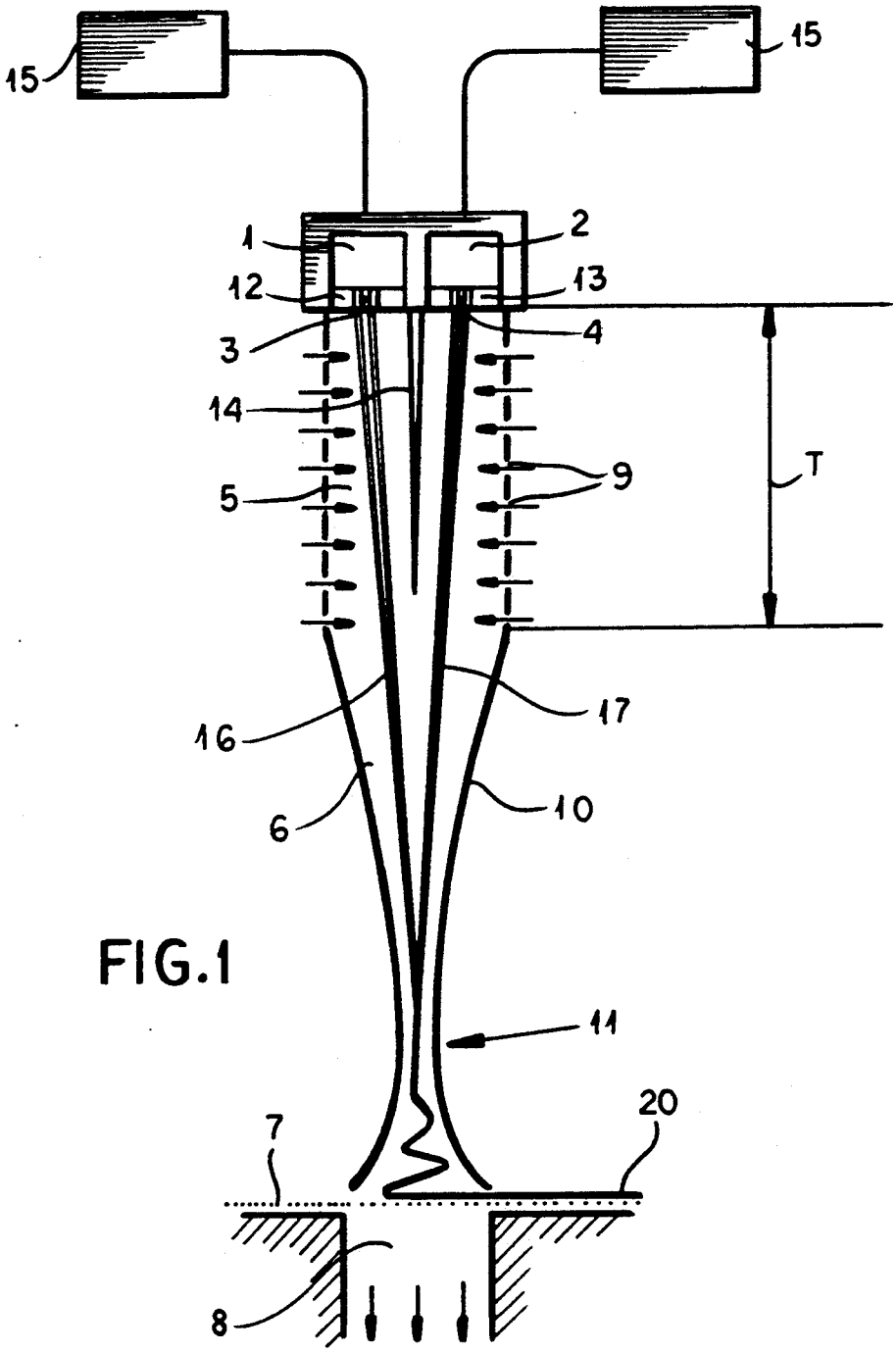
FIG. 1 is a vertical cross sectional view through an apparatus for performing the process according to my invention.

The apparatus shown in the drawing basically comprises a combined spinneret 1, 2 including a plurality of spinning nozzles 3, 4 arranged in rows over a rectangular cross section or plan outline, a blower shaft 5, a stretching shaft 6 and a fleece recovery conveyor 7 for the delivered fleece with a device 8 for drawing or moving the process air.

The blower shaft 5 is provided with a plurality of air orifices 9 for admission of stretching air which simultaneously acts as a cooling medium.

The stretching shaft 6 has stretching shaft walls 10 which can be movable and provide an accelerating device 11 which is like a venturi nozzle in vertical cross section. The fleece recovery conveyor 7, which is a wire cloth conveyor in this example, as already mentioned, is located under the stretching shaft 6.

Two parallel spinning members 12, 13 each have a separate spinneret 1, 2 respectively of the combined unit. Each separate spinneret 1, 2 or spinning member 12, 13 has a separate plurality of spinning nozzles 3, 4 located above the blower shaft 5 to emit separate bands of continuous filament.

A separating wall 14 which in this example extends over more than half the depth T of the blower shaft 5 is positioned between the spinning members 12, 13. In the embodiment according to FIGS. 1 and 3 the separating wall 14 is a closed separating wall without additional functions. In the embodiment according to FIG. 2 the separating wall 14 is a blower wall having a central air duct with an air inlet and provides both portions of the blower shaft 5 with transversely blowing air orifices 9 for cooling air.

Figure 2:
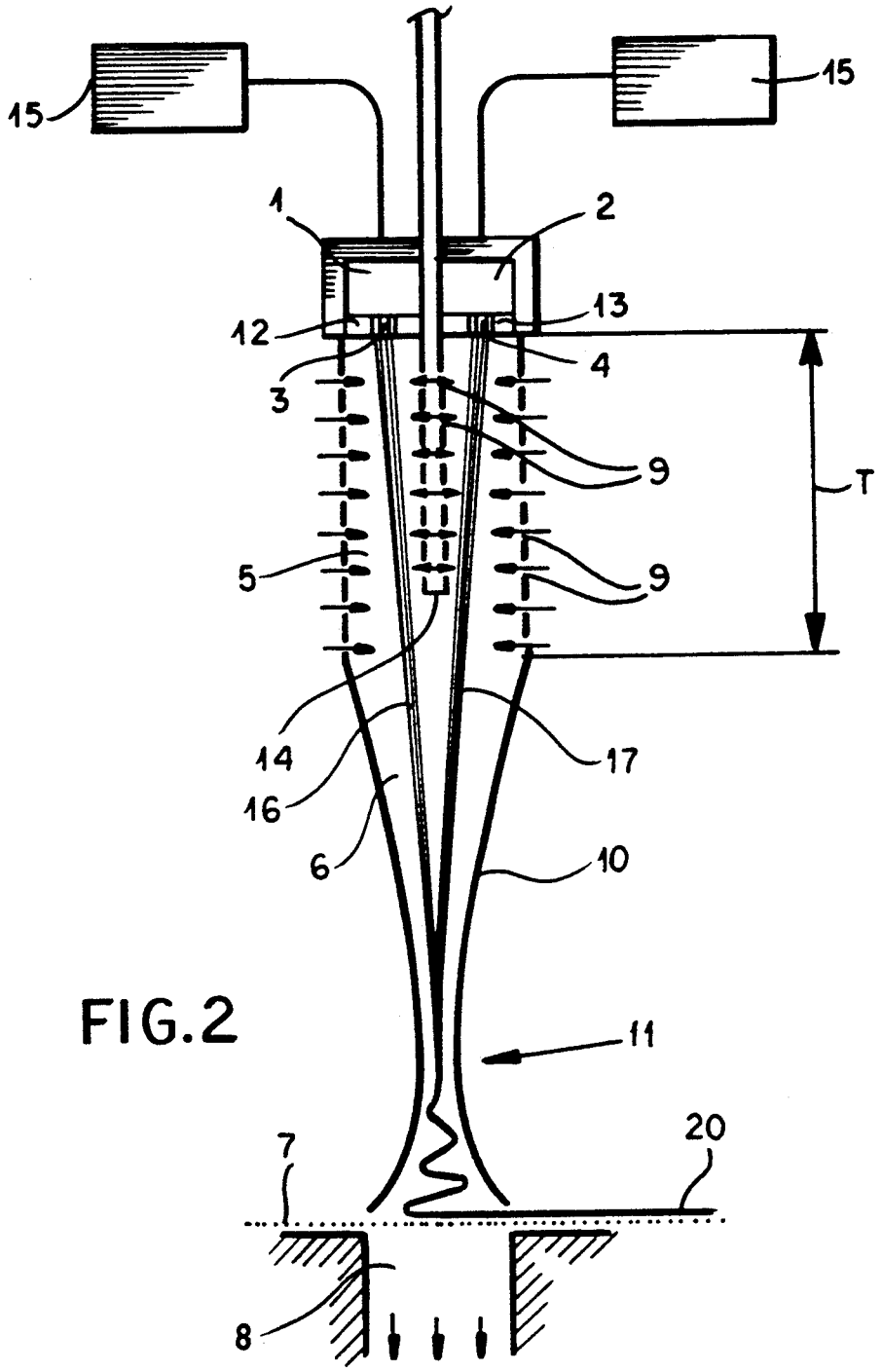
FIG. 2 is a similar view of another embodiment of an apparatus for performing the process according to my invention corresponding to that of FIG. 1.

In the embodiment according to FIGS. 1 and 2 the apparatus is connected to two extruders 15 so that the fleece can be made from different plastic materials or from different colored plastic material.

Figure 3:
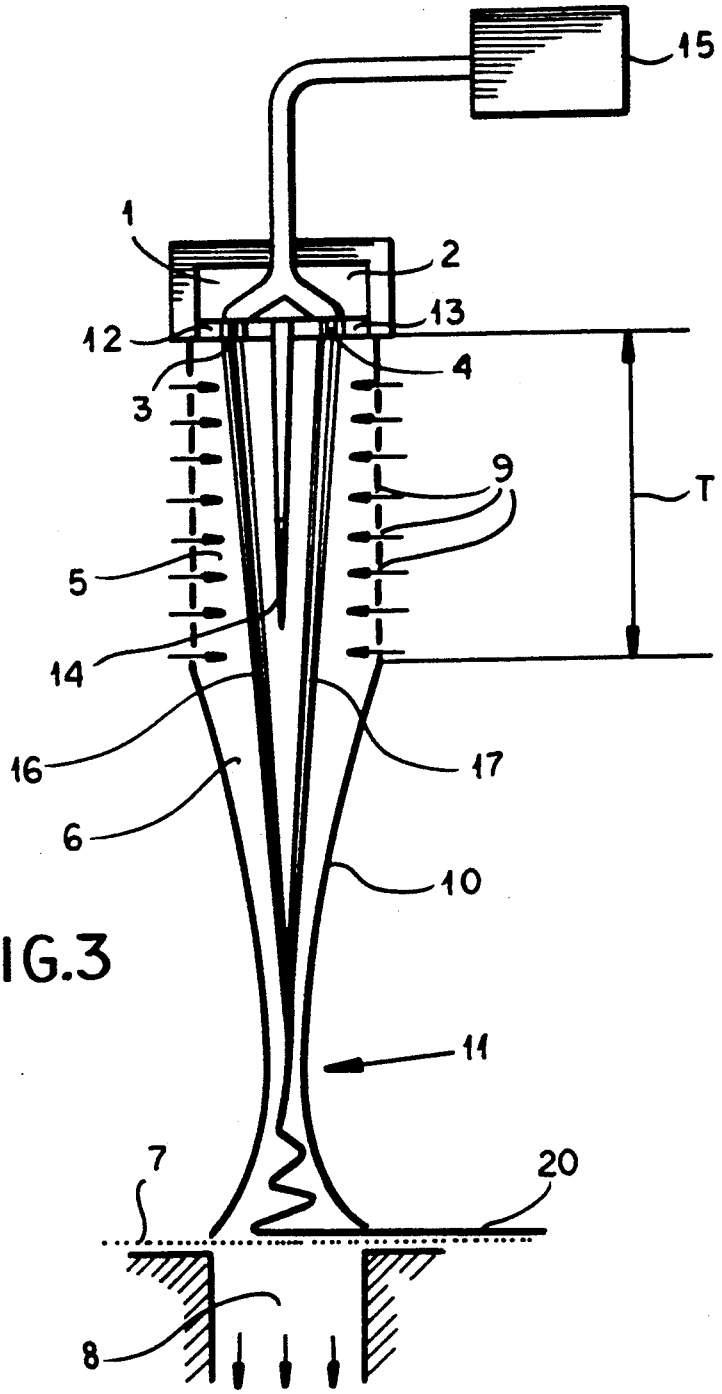
FIG. 3 is a vertical section of an additional embodiment for performing the process according to my invention.

In the embodiment according to FIG. 3 the apparatus is connected to a single extruder 15.

In all cases the separate spinnerets 1, 2 having the separate pluralities of spinning nozzles 3, 4 can have different numbers of nozzles and also differently shaped nozzles.

In continuous operation the thermoplastic material is fed to two separate spinnerets 1, 2 having the separate groups of spinning nozzles 3, 4 arranged in rows.

Two thermoplastic bands or groups of filaments 16, 17 issuing from the separate units 1, 2 are exposed to cooling air separately in separate portions of the blower shaft 5 and both plastic bands or groups of filaments 16, 17 are jointly fed into a single stretching shaft 6 and are jointly deposited on the fleece recovery conveyor 7, e.g. the wire cloth conveyor, combined into a single finished spun-filament fleece 20.

I claim:

1. A method of making a spun-filament fleece which comprises the steps of:

(a) directing downwardly in a vertical cooling shaft from two spinnerets, respective bands of continuous thermoplastic filament while separating said bands by a downwardly extending partition in said cooling shaft, said filaments being emitted from said spinnerets in rows of spaced apart filaments and different thermoplastics being emitted from the two spinnerets, one of said thermoplastics being polyethylene and another of said thermoplastics being polypropylene;

(b) cooling said bands of continuous thermoplastic filament by directing jets o cooling air inwardly against each band from a respective outer wall of the cooling shaft, and by directing jets of cooling air outwardly against said bands from respective sides of said partition;

(c) passing both of said bands together below said partition through a constricted stretching shaft below said cooling shaft in entrainment with air from said cooling shaft to stretch the filaments;

(d) collecting said bands as a mat on a receiving conveyor below said stretching shaft; and (e) drawing air downwardly through said mat and said receiving conveyor as said mat is deposited on said receiving conveyor.

2. The method defined in claim 1 wherein differently tempered thermoplastics are fed to said spinnerets.

3. The method defined in claim 1 wherein the thermoplastic synthetic resins are fed to said spinnerets at different volume rates of flow.

4. A method of making a spun-filament fleece which comprises the steps of:

(a) directing downwardly in a vertical cooling shaft from two spinnerets, respective bands of continuous thermoplastic filament while separating said bands by a downwardly extending partition in said cooling shaft, said filaments being emitted from said spinnerets in rows of spaced apart filaments, said partition having a lower edge;

(b) cooling said bands of continuous thermoplastic filament by directing jets of cooling air inwardly against each band and toward a respective side of said partition from a respective outer wall of the cooling shaft;

(c) uniting said bands below said edge and passing both of said bands together below said partition in common through a single constricted stretching shaft spaced below a lower edge of said cooling shaft in entrainment by air to stretch the filaments;

(d) collecting said bands as a mat on a receiving conveyor below said stretching shaft; and (e) drawing air downwardly through said mat and said receiving conveyor as said mat is deposited on said receiving conveyor.

* * * * *